United States Patent [19]

Gentry

[11] 4,417,488

[45] Nov. 29, 1983

[54] TELESCOPING NUT DRIVER

[75] Inventor: Samuel Gentry, La Mesa, Calif.

[73] Assignees: Paul W. Green; Wayne R. Green, both of San Diego, Calif. ; part interest to each

[21] Appl. No.: 267,801

[22] Filed: Jun. 5, 1981

Related U.S. Application Data

[63] Continuation-in-part of Ser. No. 159,765, Jun. 16, 1980, Pat. No. 4,307,634.

[51] Int. Cl.[3] ..... B25B 13/58

[52] U.S. Cl. ..... 81/185; 81/177 E

[58] Field of Search ..... 81/185, 439, 177 E, 81/177 N; 7/158

[56] References Cited

U.S. PATENT DOCUMENTS

| | | | |
|---|---|---|---|
| 2,822,714 | 2/1958 | Paparelli | 81/185 X |
| 2,938,417 | 5/1960 | Haber | 81/185 |
| 3,285,106 | 11/1966 | Svenson | 81/185 |
| 3,965,510 | 6/1976 | Ernst | 7/158 |

*Primary Examiner*—James G. Smith

*Attorney, Agent, or Firm*—Brown & Martin

[57] ABSTRACT

A telescoping hex head nut driver comprising a first hexagonal head on a shank. A handle is attached to said shank. Smaller hexagonal heads and shanks telescope within the first hexagonal head and shank. The inner heads can be extended to engage smaller hex head nuts, and simple and easy to use means are provided in the handle to extend and retract the inner sockets.

8 Claims, 5 Drawing Figures

TELESCOPING NUT DRIVER

This application is a continuation-in-part of U.S. patent application Ser. No. 159,765, filed June 16, 1980, now U.S. Pat. No. 4,307,634.

BACKGROUND OF THE INVENTION

This invention relates to hand tools and in particular to a new and improved hexagonal nut driver.

In cabinetry and other components of appliances such as refrigerators, trash compactors, dishwashers, TV cabinets and major appliances such as furnaces and air-conditioners, whether in homes or in buildings such as for offices, apartments and the like, three standard size fasteners constitute approximately 90% of all the fasteners used. Such fasteners are ¼ inch, 5/16 inch and a ⅜ inch hexagonal sheet metal nuts (Hexnuts). Consequently, to service such appliances, it is common practice to use three separate and distinct hexnut drivers to disassemble and reassemble the appliances. For example, to change a door gasket in a refrigerator, a ¼ inch hexnut driver is required. To change an evaporator fan motor, a 5/16 hexnut driver is used. If other parts are needed to be changed, usually still another hexnut driver, a ⅜ inch size, is used.

One of the problems in the industry is that often the service man spends half his time exchanging tools to service the appliance and sometimes at least one of the tools is missing or misplaced so that a trip to another location to find the missing tool is necessary. This problem is further complicated by the fact that, while a screwdriver can sometimes replace the missing tool, it has become increasingly popular to eliminate the screwdriver slot from the hexnut so that this substitution is becoming impossible.

In any event, with the necessity for three separate tools, possibly four if a screwdriver is needed to do the job, it is apparent that servicing appliances is unnecessarily time consuming and bothersome. There is a need for a single, easy to use tool to replace the present three or four tools.

SUMMARY OF THE INVENTION

The invention which attains the foregoing object comprises a tool having a first or outside hexagonal (hex) head, for engaging a hexnut of a selected size. A shank extends from the head with a handle surrounding a portion of the shank. Two additional smaller hexagonal heads and shanks are nested in telescoping relationship within the outer head shank and handle. These two heads and shanks are capable of being extended outwardly, individually, of the first hex head for engaging smaller hexnuts. The size of the two telescoping hex heads are such that the sidewalls of the heads engage in sliding relationship. Relative rotation therebetween is thus prevented and the inner heads are so arranged that the hex heads when nested (retracted) serve as stop mechanisms for the hexnut being driven at the time.

The two outer hex heads serve as strengthening devices for the inner hex heads so that additional torque can be applied to the hex nut being driven without damage to the hex head which engaged the hex nut. The two inner telescoping shanks are provided with means slidable along the handle for extending and retracting the two inner shanks and for selectively locking them in position.

It will be clear to those skilled in this art that, in addition to being a convenience and a timer saver, the ability of this tool to extend the smaller hex heads to engage a correspondingly sized hexnut has the advantage of allowing the head to engage such a hexnut whether near a flange or in a concave or recessed area where the larger hexagonal head would otherwise interfere. It has been suggested that an alternative to this tool would be a socket type driver where the inner sockets would be spring loaded and flush with the outer socket end so that the inner sockets would retract against the spring load when the hexnut for the outer socket was being driven, but this type of driver would not be useful where the hexnut to be driven is located near a flange or in a concave or recessed area.

DETAILED DESCRIPTION OF THE INVENTION

Figure 1:
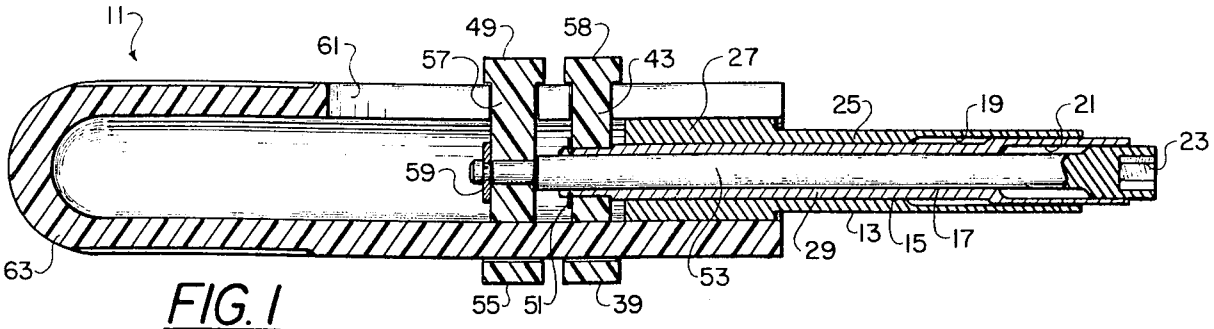
FIG. 1 is a mid-sectional elevation of a nut driving tool embodying the present invention.

Referring to the drawings, a telescoping hexnut driver tool is shown at 11 in FIG. 1. The hexnut driver tool includes an outer hexnut driver 13, a middle hexnut driver 15 and an inner hexnut driver 17. The outer nut driver has a hexagonal head 19 and two inner hexagonal heads 21 and 23 on the middle and the inner nut drivers are disposed in telescoping relationship within the head 19. The outer hexagonal head is formed on an elongated tubular hollow shank 25. The shank 25 is part of a hexagonal plug 27 and can be formed as part of the plug or press fitted into the plug.

Figure 2:
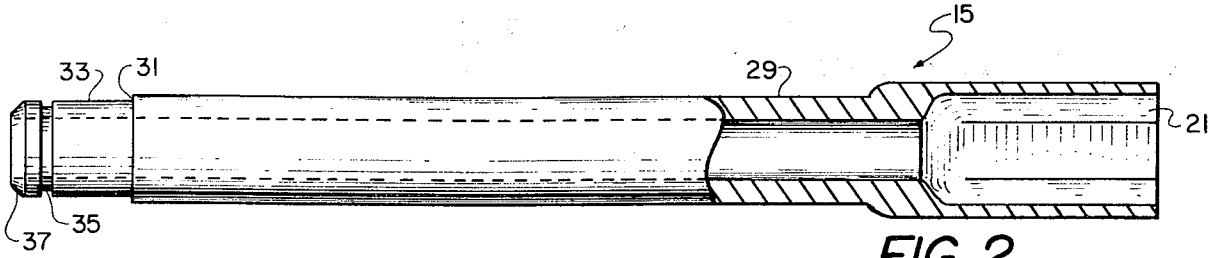
FIG. 2 is a side view of the middle nut driver.
Figure 3:
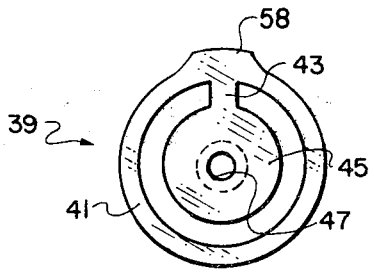
FIG. 3 is a front elevation of one of the ring members used to move and lock the two inner nut drivers.
Figure 4:
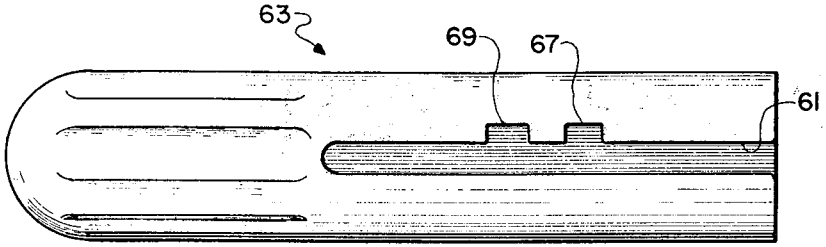
FIG. 4 is a top view of the handle of the nut driving tool.
Figure 5:
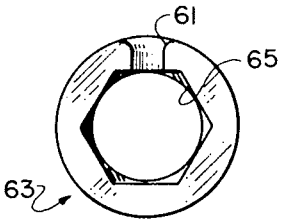
FIG. 5 is a front end view of the handle.

The middle nut driver 15 (FIGS. 1 and 2) includes a hollow tubular shank 29 extending from the hexagonal head 21. The diameter of the shank is reduced near the inner end to provide a shoulder 31 and ring support 33. A snap ring groove 35 is formed in the ring support 33 and the end of the ring support 33 can be beveled at 37 to facilitate the insertion of the ring support into a ring member 39 (FIGS. 1 and 3). The ring member 39 includes an outer ring 41 having a neck 43 extending radially inward. The neck terminates in an inner ring 45 having a central opening 47 therein. A ring positioner 58 is formed on the outer circumference of the ring member 39 in alignment with the neck 43. This facilitates movement of the ring by the user.

Ring member 39 is slid over the chamfered end of shank 29 and the diameter of opening 47 in inner ring 45 is slightly larger than the circumference of the ring support 33 on shank 29 so that the ring may rotate on the support. The forward end of the ring 45 abuts against the shoulder 31 adjacent the ring support 33. A snap ring 51 is inserted into groove 35 and holds the ring member 39 in position on the ring support 33.

The inner nut driver 17 includes a shank 53 which is circular in cross section and is solid to give it additional strength since it the smallest of the nut drivers. The inner nut driver has a ring member 55 similar to ring member 39 which is assembled to the shank 53 of the inner nut driver in the same manner as the ring member 39 is assembled to the shank 29 of the middle nut driver 15. The ring member 55 includes the neck 57 and ring positioner 49 and is held in place by the snap ring 59.

The shank 53 of the inner nut driver assembly is inserted into the hollow shank 29 of the middle nut driver assembly, and these assemblies are inserted into the hollow shank 25 of the outer nut driver 13. The necks 57 and 43 of the ring members 55 and 39 are aligned and slide within an axial slotted track 61 in handle 63. The handle has a hexagonal opening 65 at the forward end and hexagonal plug 27 fits snuggly into the opening 65. The plug is easily removed by grasping the shank 25 of the outer nut driver 13 and removing the plug from the opening in an axial direction.

The necks 43 and 57 on ring members 39 and 55 fit in sliding engagement within the track 61 in the handle 63. Two notches 67 and 69 are formed in the side of the track 63.

When the middle nut driver 15 is used, the ring member 39 is moved axially forward and extends beyond the end of the outer nut driver 13. At this point, the user rotates the ring member 39 until the neck 43 is seated within slot 67. The middle nut driver 15 is then in position for use.

When the inner nut driver 17 is to be used, the ring member 55 is moved forward in track 61 and is rotated until its neck 57 engages slot 69. The inner nut driver 17 now extends beyond both the outer nut driver 13 and the middle nut driver 15.

To again use the middle nut driver 15, the ring member 55 is rotated in the direction which will remove the neck 57 out of the notch 69 and in alignment with the track 61. The ring member 55 is then slid back in track 61 on handle 63 until the middle nut driver head 21 is exposed for use.

If it is now desired to use the outer nut driver 13, the ring member 39 is rotated until its neck 43 is aligned with track 61 in the handle, and the middle nut driver 15 is moved back until the outer nut driver head 19 is exposed for use.

The nut drivers are color coded to identify the size of the nut driver being used. The ring 55 is red, which is understood in the trade to indicate a $\frac{1}{4}$ inch size. The ring 39 is yellow, which indicates 5/16 inch size. The handle is blue, which indicates $\frac{3}{8}$ inch size.

Should any one of the inner nut drivers become rounded or broken, it is extremely easy to replace it by removing one snap ring, removing the defective nut driver and inserting another one.

The ring members render the tool extremely easy to use and handle even in close quarters. They provide a positive, reliable means of manipulating the nut drivers. They also facilitate the use of color coding which is easy to see and understand.

The nut driver tool of the present invention takes the place of three or more tools for driving a majority of fasteners used in applicances and is constructed and arranged so that it is extremely easy to use.

Having thus described my invention, I claim:

1. A telescoping hexagonal nut driver tool having a plurality of hexagonally shaped heads, each forming a socket of a different size and adapted to engage correspondingly sized hexagonal nuts for driving said nuts by rotational movement, comprising:

a first hexagonal socket means having a hollow shank;

a cylindrical handle surrounding a portion of said shank on said first socket means, said handle having an axial slot open at the forward end and notch means in the side of said slot;

a second hexagonal socket means smaller than said first hexagonal socket means for positioning within said first socket means in sliding engagement with the inner side walls of said first socket means, said second socket means having a shank and telescoping outwardly beyond said first socket means;

a first circular positioning means in sliding engagement on said handle with a neck extending through said handle slot behind said first socket means shank;

an inner ring on said neck and having an opening in the center thereof for surrounding said second socket means shank;

retaining means for retaining said inner ring on said second socket means shank for preventing axial movement and permitting rotational movement of said ring on said shank for seating said neck in said notch means;

a third hexagonal socket means smaller than said second hexagonal socket means for positioning within said second socket means in sliding engagement with the inner side walls of said second socket means, said third socket means having a shank and telescoping outwardly beyond said second socket means;

a second circular positioning means in sliding engagement on said handle with a neck extending through said handle slot behind said second socket means shank;

an inner ring on said neck and having an opening in the center thereof for surrounding said second socket means shank; and retaining means for retaining said inner ring on said second socket means shank for preventing axial movement and permitting rotational movement of said ring on said shank for seating said neck in said notch means.

2. A nut driver tool according to claim 1 wherein said first and second positioning means are formed of plastic.

3. A nut driver tool according to claims 1 or 2 wherein the positioning means and handle are color coded to indicate the size of the associated socket means.

4. A nut driver tool according to claim 1 wherein said first socket means includes a hexagonal plug for snuggly fitting within a hexagonal section in the open end of said handle.

5. A nut driver tool according to claim 1 wherein said third socket means shank is solid.

6. A nut driver tool according to claim 1 wherein the shanks of said socket means are circular.

7. A nut driver tool according to claim 1 wherein said positioning members extend more than half way around said handle.

8. A nut driver tool according to claim 7 wherein said positioning members extend completely around said handle.

* * * * *